US006640365B1

(12) United States Patent
Chang

(10) Patent No.: US 6,640,365 B1
(45) Date of Patent: Nov. 4, 2003

(54) ELECTRIC BED

(76) Inventor: Kuo-Heey Chang, No. 752, Chung Hsiao Rd., Chiayi (TW)

( * ) Notice: Subject to any disclaimer, the term of this patent is extended or adjusted under 35 U.S.C. 154(b) by 0 days.

(21) Appl. No.: 10/252,707

(22) Filed: Sep. 24, 2002

(51) Int. Cl.[7] ..... A61G 7/015
(52) U.S. Cl. ..... 5/618; 5/616
(58) Field of Search ..... 5/618, 613, 616, 5/617

(56) References Cited

U.S. PATENT DOCUMENTS 3,593,350 A * 7/1971 Knight ..... 5/616
3,821,821 A * 7/1974 Burst et al. ..... 5/616
3,898,702 A * 8/1975 Goodman ..... 5/618
4,361,917 A * 12/1982 Wilson ..... 5/616
6,006,379 A * 12/1999 Hensley ..... 5/618
6,088,853 A * 7/2000 Jansen ..... 5/618
6,101,647 A * 8/2000 Stroud et al. ..... 5/618
6,216,295 B1 * 4/2001 Pearson ..... 5/618
6,276,011 B1 * 8/2001 Antinori ..... 5/618
6,393,641 B1 * 5/2002 Hensley ..... 5/618
6,499,162 B1 * 12/2002 Lu ..... 5/618
2001/0000828 A1 * 5/2001 Hensley ..... 5/618

* cited by examiner

*Primary Examiner*—Robert G. Santos
(74) *Attorney, Agent, or Firm*—Rosenberg, Klein & Lee

(57) ABSTRACT

An adjustable electric bed includes several bedplates pivotally connected in sequence. One of the bedplates is movable together with a piston rod of an electric cylinder. Connecting elements are pivoted to respective ones of the other bedplates at first ends, and pivoted to a stationary base at second ends. When the piston rod moves, the connecting elements pivot on the bedplates and the base to prop up the bedplates in various positions. A first one of the connecting elements consists of pivotally connected upper and lower parts so that objects accidentally placed under the upper part cannot be damaged by the upper part in adjustment operation of the bed. The other connecting elements are each formed with an elongated hole for the pivotal connection so as not to damage objects or injure user's hands that are placed under them.

1 Claim, 7 Drawing Sheets

ELECTRIC BED

BACKGROUND OF THE INVENTION

1. Field of the Invention

The present invention relates to an electric bed, which is equipped with a moving mechanism, mid several bedplates capable of being adjusted in orientation by means of the moving mechanism, more particularly an electric bed, which is constructed such that the bedplates and other associated parts will not damage objects or injure hands of users that are accidentally placed under the bedplates in the orientation adjusting operation.

2. Brief Description of the Prior Art

Adjustable electric beds are very popular with patients who need to lie down to rest for a long time because they can be adjusted among various positions to provide different users with comfort.

HENSLEY disclosed, in U.S. Pat. No. 6,006,379, an articulating bed frame, which includes a base frame 12, a carriage 30, an articulating upper frame 40, and first drive assembly 50. The carriage is mounted on the base frame 12 to be able to shift relative to the base frame 12. Rollers 32 are guided along longitudinally extending channels of the base frame 12. The articulating upper frame 40 consists of an upper body frame section 42, a seat frame section 44, a thigh frame section 46 and a lower leg frame section 48, and is mounted on the carriage 30 at the seat frame section 44 with the upper body frame section 42 being movable relative to the base frame 12 for articulating movement thereof The first drive assembly 50 is provided for raising and lowering the upper body frame section 42 relative to the base frame 12. The first drive assembly 50 includes a first linkage assembly 60 connected to the articulating upper frame 40 such that the upper body frame section 42, when tilted, shifts the articulating upper frame 40 longitudinally relative to the base frame 12.

However, this bed frame has a disadvantage that the articulating upper frame 40 is likely to cause injury to user's hands or cause damage to objects on the course of the upper body frame section 42 being tilted if the users put their fingers or objects between the base frame 12 and the articulating upper frame 40 accidentally.

SUMMARY OF THE INVENTION

It is a main object of the present invention to provide an electric bed, which is constructed such that the parts thereof will not damage body parts of users accidentally placed under the bedplates in the orientation adjusting operation thereof.

In the electric bed of the present invention, first connecting rods each consists of pivotally connected upper and lower parts so that the lower parts can pivot up in position adjusting operation of the bed in case there are objects under the upper parts, preventing the upper part from causing damage to the objects in the position adjusting operation of the bed. In addition, second, and third connecting rods are each formed with an elongated hole at the lower end for pivotal connection with the base, and the sliding member respectively, in other words pivotal pins are passed through the elongated holes for the pivotal connection of the connecting rods with the base, and the sliding member respectively. Thus, the second, and the third connecting rods are allowed to move upwards in adjusting operation of position of the bed in case there are obstacles under them, not causing damage to the obstacles in the adjusting operation of the bed.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
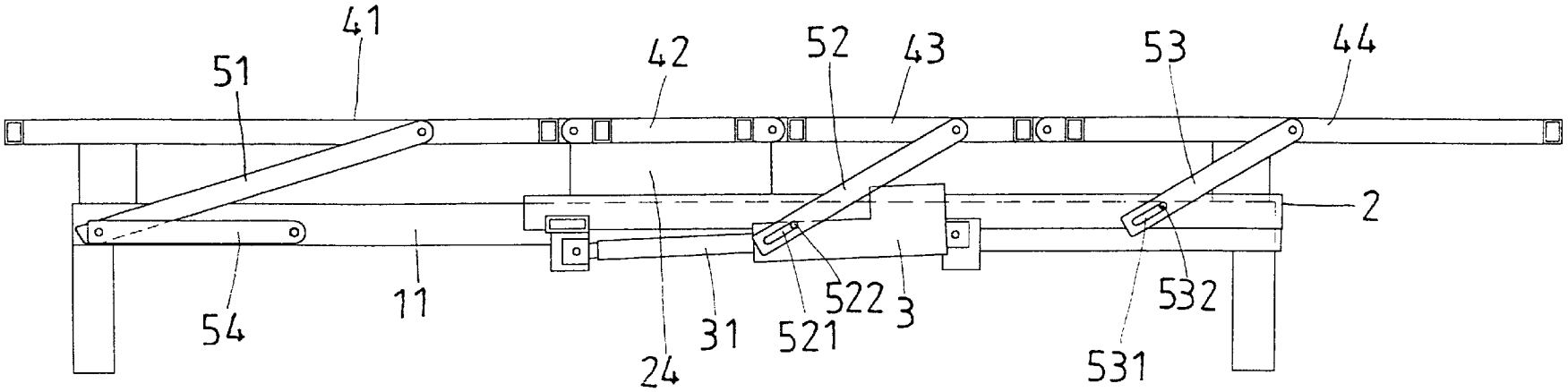
FIG. 1 is a side view of the electric bed of the present invention.
Figure 3:
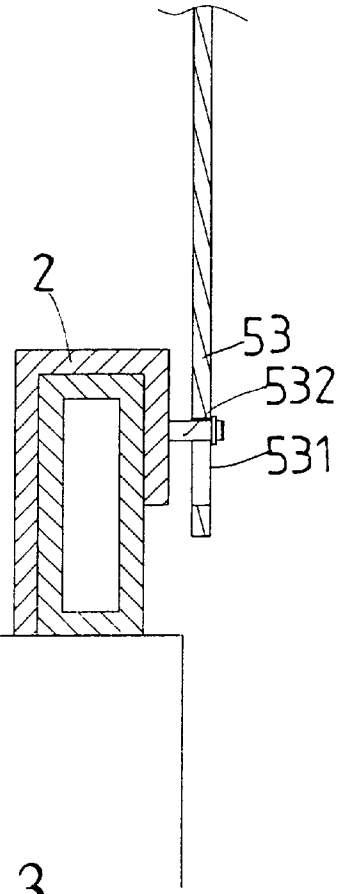
FIG. 3 is another partial cross-sectional view of the electric bed of the present invention.
Figure 2:
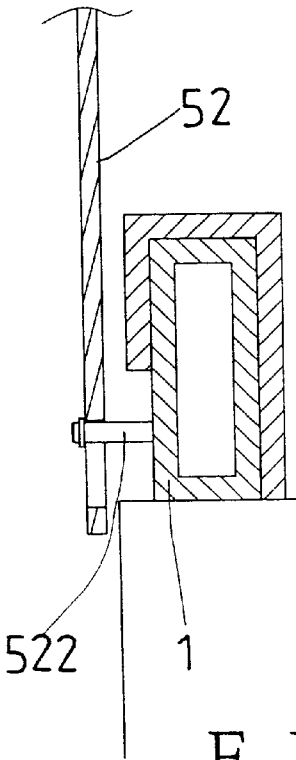
FIG. 2 is a partial cross-sectional view of the electric bed of the present invention.

Referring to FIG. 1, an adjustable electric bed according to the present invention includes a base 1, a sliding member 2, an electric cylinder 3, a bedplate combination, and a connecting rod combination.

The sliding member 2 is fitted to the base 1, and is movable relative to the same. The electric cylinder 3 is affixed to the base 1 with a piston rod 31 thereof being connected to the sliding member 2 so that the sliding member 2 can be moved together with the piston rod 31 when the cylinder 3 operates.

The bedplate combination includes a first, a second, a third, and a fourth bedplates 41, 42, 43, and 44 like that of the conventional electric bed. The second bedplate 42 is firmly connected to a connecting block 24 of the sliding member 2 at a lower side thereof. A front edge of the second bedplate 42 is pivotally connected to a rear edge of the first bedplate 41, while a rear edge of the second bedplate 42 is pivotally connected to a front edge of the third mattress 43. And, a front edge of the fourth bedplate 44 is pivotally connected to a rear edge of the third bedplate 43.

The connecting rod combination includes a pair of first connecting rods, a pair of second connecting rods 52, and a pair of third connecting rods 53. Each of the first connecting rods are pivotally connected to the first bedplate 41 at an upper end, and pivoted to the base 1 at a lower end. Each of the second connecting rods 52 are pivotally connected to the third bedplate 43 at an upper end, and pivoted to the base 1 at a lower end. And, each of the third connecting rods 53 are pivotally connected to the fourth bedplate 44 at an upper end, and pivoted to sliding member 2 at a lower end.

Figure 4:
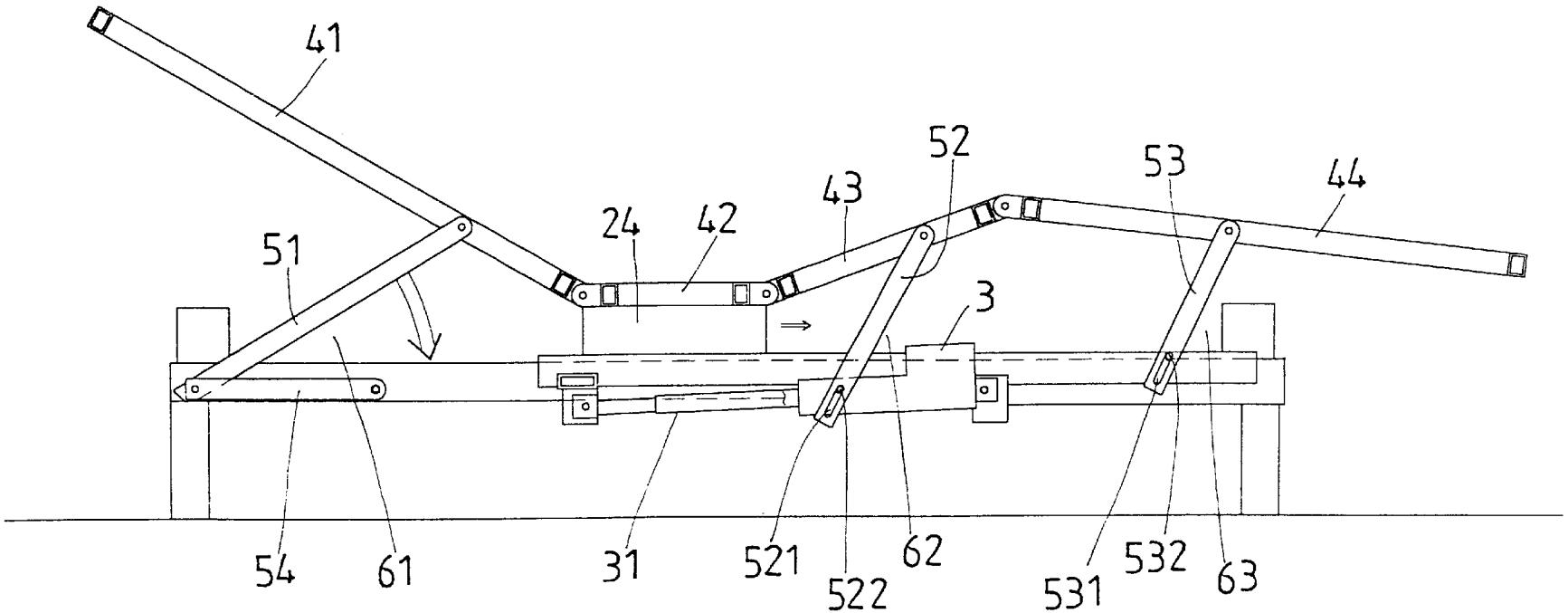
FIG. 4 is a side view of the electric bed of the present invention tinder position adjusting operation.

Referring to FIG. 1, the sliding member 2 is disposed in a first position, and the bedplates 41, 42, 43, and 44 are horizontal. Referring to FIG. 4, the sliding member 2 is moved towards the front end of the base 1 to a second position, and the first, the second, and the third connecting rods prop up the respective bedplates 41, 43, and 44 to sloping, position. Thus, like the conventional electric bed in the Background, the present electric bed can be adjusted with the first, the third, and the fourth bedplates 41, 43, and 44 being moved among various sloping positions when the sliding member 2 is moved relative to the base 1.

In light of the fact that the connecting rods are likely to pivot down to damage objects or injure people's body parts that are accidentally placed on the base 1 on the course of the sliding member 2 moving for adjustment of position of the mattresses. The connecting rods of the present electric bed are constricted such that they are allowed to move up relative to the base 1 when the sliding member 2 is moving from the second position to the first one. Therefore, in case objects or people's body parts are accidentally placed on the base 1, the connecting rods are less likely to cause damage to the same.

Figure 5:
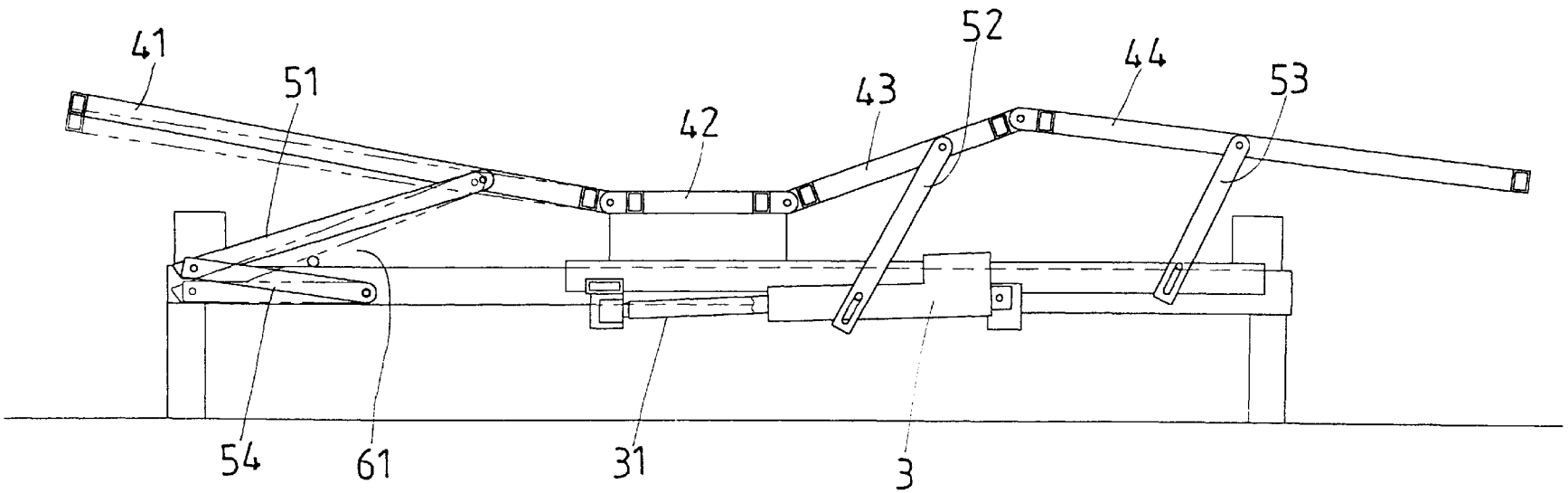
FIG. 5 is a view showing movement of a connecting rod in position adjusting operation of the electric bed when obstacles are placed under it.
Figure 6:
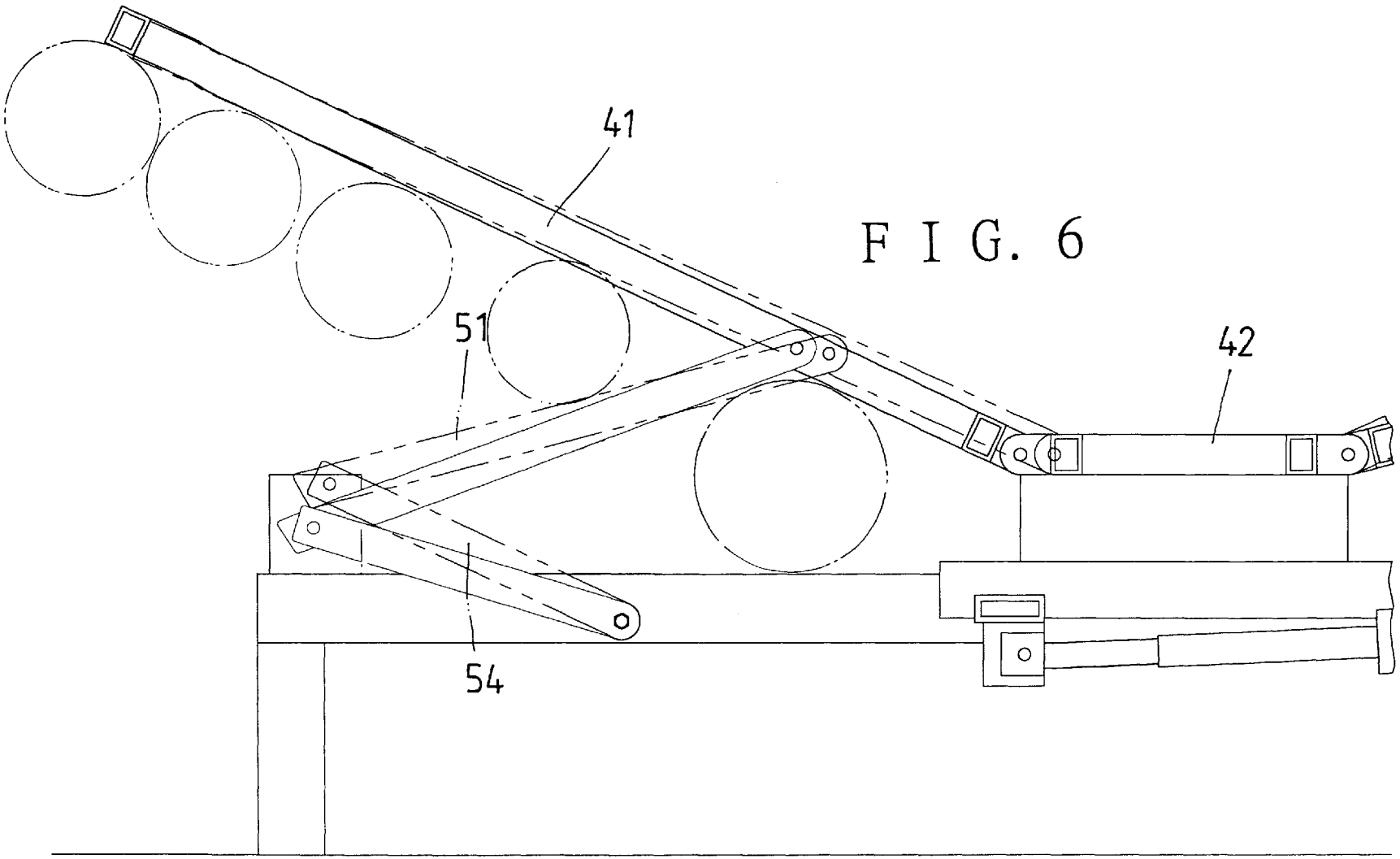
FIG. 6 is a partial enlarged view of the electric bed in FIG. 5.

The improvement of the connecting rods is detailed herein: Each of the first connecting rods consists of two pivotally connected parts 51, and 54, which are pivotally connected to the first bedplate 41, and the base 1 respectively. Referring to FIGS. 5, and 6, the lower part 54 is moved up relative to the base 1 in position adjusting operation of the bed when there are obstacles under the upper part 51, preventing the upper part 51 from moving further down to damage the obstacles. In case there are obstacles between the base 1 and the upper part 51, movement of the first connecting rods, on the course of the sliding member 2 moving from left to right, will be divided into sequence of actions: (1) the upper part 51 pivoting down; (2) the upper parts 51 coming into contact with the obstacles; (3) the joint of the upper part and the lower part 51, 54 moving upwards (FIG. 6); (4) the lower part 54 pivoting up to prop up the upper part 51 so that the upper part 51 props up the first bedplate 41; (5) the upper part 51 moving away from the obstacles; (6) the lower part 54 pushing the obstacles away.

Figure 7:
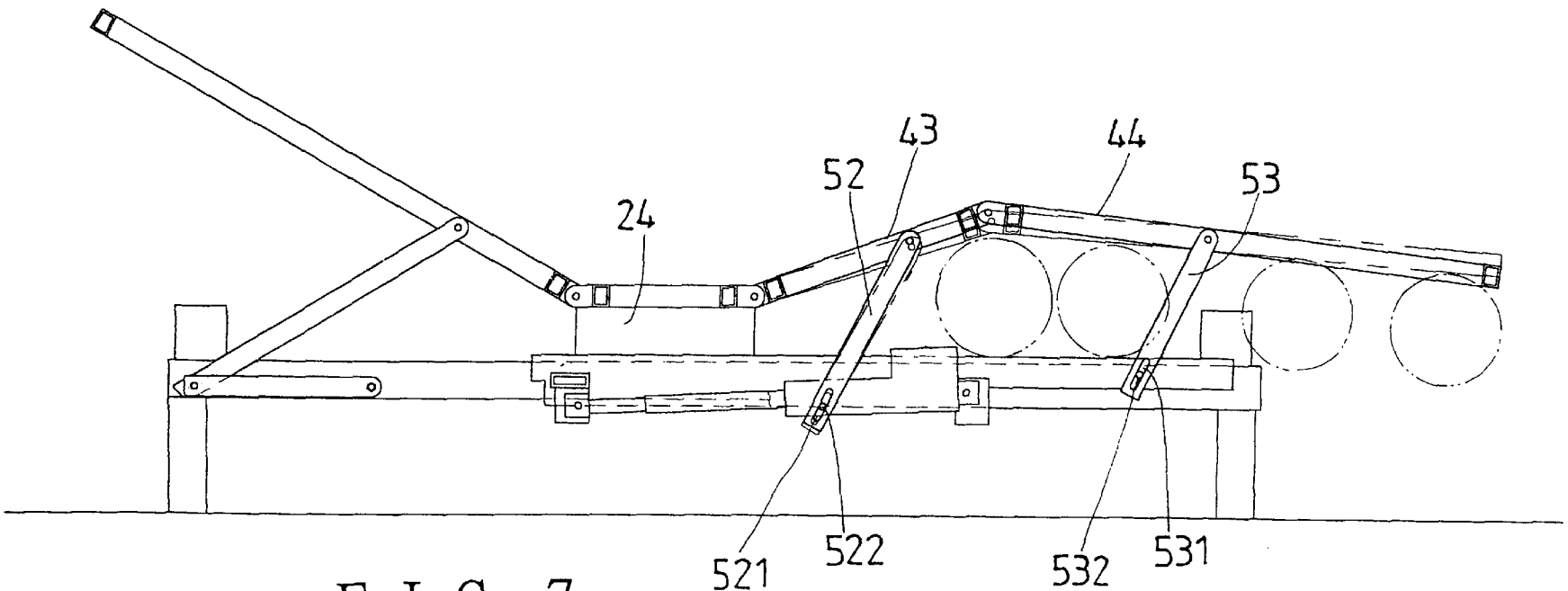
FIG. 7 is a view showing movement of another connecting rod in position adjusting operation of the electric bed when obstacles are placed under it.
Figure 8:
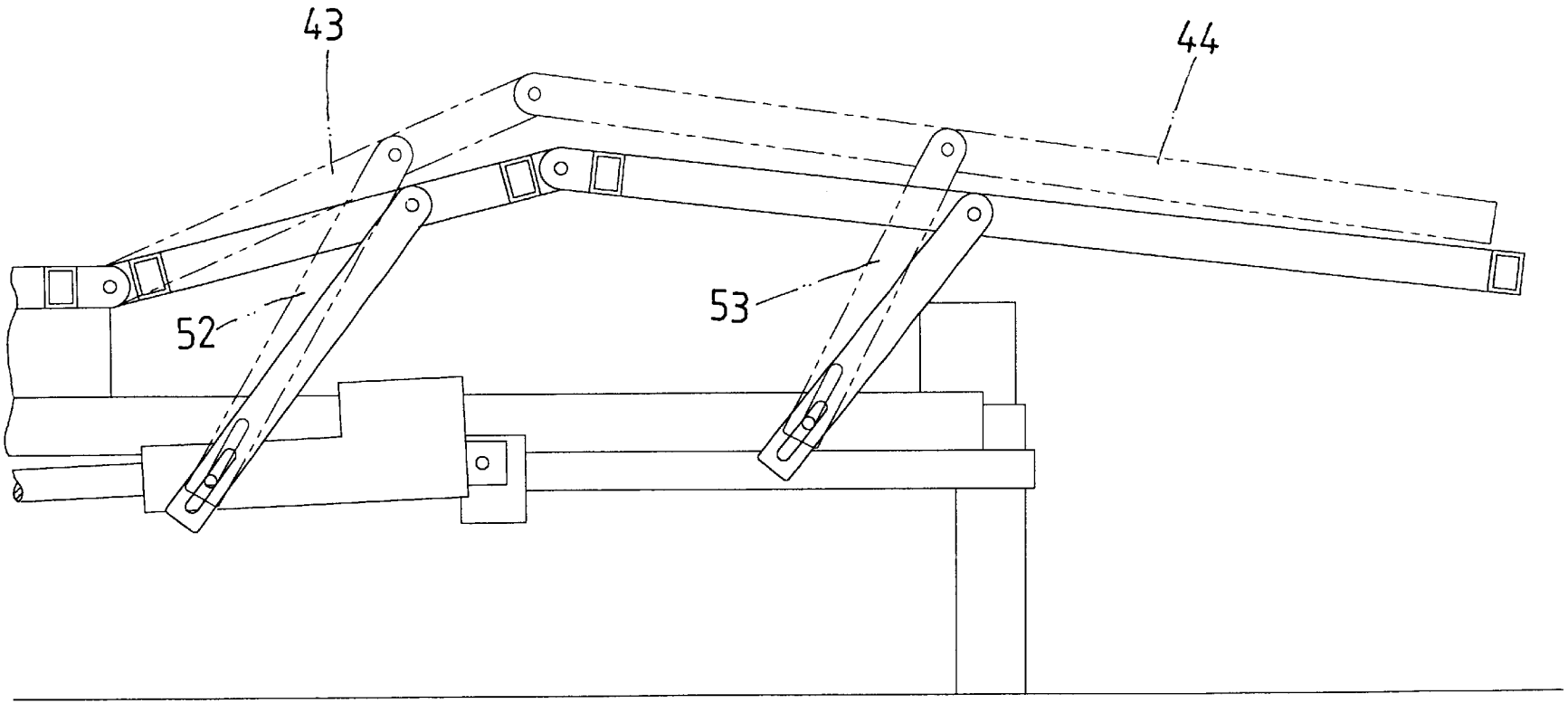
FIG. 8 is a view showing movement of yet another connecting rod in position adjusting operation of the electric bed when there are obstacles.

Furthermore, each of the second, and the third connecting rods 52, and 53 is formed with an elongated hole 521, 531 at the lower end for allowing the pivotal connection thereof with the sliding member 2, and the base 1 respectively. In other words, pivotal rods 522 are passed through the elongated holes 521, and joined to the base 1; thus, the second connecting rods 52 are allowed to move upwards in position adjusting operation of the bed in case there are objects under them, preventing damage of objects accidentally placed under the connecting rods 52 in the position adjusting operation of the bed, as shown in FIG. 7. Similarly, pivotal rods 532 are passed through the elongated holes 531, and joined to the sliding member 1; thus, the third connecting rods 53 are allowed to move upwards in position adjusting operation of the bed in case there are obstacles under them, preventing damage of objects accidentally placed under the connecting rods 53 in the position adjusting operation of the bed. In case there are obstacles between the base 1 and the second connecting rod 52, movement of the second connecting rod 52, on the course of the sliding member 2 moving from left to right, will be divided into sequence of actions: (1) the connecting rod 52 pivoting down; (2) the connecting rod 52 coming into contact with the obstacles; (3) the joint of the connecting rod 52 and the third bedplate 43 moving upwards; (4) the elongated hole 521 moving up relative to the pivotal rod 522. In case there are obstacles between the base 1 and the third connecting rod 53, movement of the third connecting rod 53 will be similar to that of the second rod 52 on the course of the sliding member 2 moving from left to right.

From the above description, it can be easily seen that the present electric adjustable bed has advantages as followings:

1. The bedplates 41, 43, and 44 move down in adjustment only due to gravity without other external force being exerted on them, therefore there is no risk of the users getting seriously injured if they put their hands under the bedplates.
2. The pivotally connected parts 51, and 54 are moved up relative to the base 1 in adjusting operation of the bed if obstacles or user's hands are put under the upper part 51, preventing the bedplate 41 from moving further down to cause damage or injury.
3. The bedplates 43, 44 will move down only due to gravity without other external force being exerted on them if obstacles or user's hands are accidentally put under the same because presence of the elongated holes 521, 531 on the connecting rods 52, 53.

What is claimed is:

1. An adjustable electric bed, comprising a first, a second, a third, and a fourth bedplates; the bedplates being arranged in sequence and pivotally connected to adjacent ones thereof at front and rear edges;

a base provided for supporting the bedplates;

a sliding member fitted to the base and movable relative to same; the sliding member being firmly connected to the second bedplate at an upper side thereof;

an electric cylinder affixed to the base; a piston rod of the cylinder being connected to the sliding member for moving the sliding member together with it when the cylinder operates;

a connecting rod combination; the connecting rod combination including:

i. a pair of first connecting rods; each of the first connecting rods being pivoted to the first bedplate at an upper end and pivoted to the base at a lower end so that the first bedplate is adjusted among various sloping positions when the sliding member is moved relative to the base;

ii. a pair of second connecting rods; each of the second connecting rods being pivoted to the third bedplate at an upper end and pivoted to the base at a lower end so that the third bedplate is adjusted among various sloping positions when the sliding member is moved relative to the base;

iii. a pair of third connecting rods; each of the third connecting rods being pivoted to the fourth bedplate at an upper end and pivoted to the sliding member at a lower end so that the fourth bedplate is adjusted among various sloping positions when the sliding member is moved relative to the base;

the connecting rod combination being characterized by the first connecting rods each consisting of pivotally connected upper and lower parts so that the upper parts are allowed to move up in position adjusting operation of the bed in case there are objects under the upper parts, not causing damage to the objects in the position adjusting operation of the bed;

the connecting rod combination being characterized by the second, and the third connecting rods being each formed with an elongated hole at the lower end for the pivotal connection with the base, and the sliding member respectively so that the second, and the third connecting rods are allowed to move upwards in position adjusting operation of the bed in case there are obstacles under them, not causing damage to the obstacles in the position adjusting operation of the bed.

* * * * *